US012287122B1

(12) United States Patent
Sun

(10) Patent No.: US 12,287,122 B1
(45) Date of Patent: Apr. 29, 2025

(54) AIR COOLER

(71) Applicant: Shenzhen Yipin Shidai Technology Co., Ltd, Guangdong (CN)

(72) Inventor: Tinglong Sun, Guangdong (CN)

(73) Assignee: Shenzhen Yipin Shidai Technology Co., Ltd, Shenzhen (CN)

( * ) Notice: Subject to any disclaimer, the term of this patent is extended or adjusted under 35 U.S.C. 154(b) by 0 days.

(21) Appl. No.: 18/824,887

(22) Filed: Sep. 4, 2024

(30) Foreign Application Priority Data

Oct. 10, 2023 (CN) ..... 202322718050.0

(51) Int. Cl.

| | |
|---|---|
| ***F24F 6/12*** | (2006.01) |
| ***F24F 5/00*** | (2006.01) |
| ***F24F 6/00*** | (2006.01) |
| ***F24F 11/36*** | (2018.01) |
| ***F24F 13/08*** | (2006.01) |

(52) U.S. Cl.
CPC ..... *F24F 6/12* (2013.01); *F24F 5/0035* (2013.01); *F24F 11/36* (2018.01); *F24F 13/084* (2013.01); *F24F 2006/008* (2013.01)

(58) Field of Classification Search
CPC ..... F24F 13/15; F24F 5/0035; F24F 6/12
See application file for complete search history.

(56) References Cited

U.S. PATENT DOCUMENTS

2022/0235953 A1* 7/2022 Zou ..... F24F 13/082

FOREIGN PATENT DOCUMENTS

| | | | | |
|---|---|---|---|---|
| CN | 111388720 A | * | 7/2020 | |
| CN | 213208094 U | * | 5/2021 | |
| CN | 113907432 A | * | 1/2022 | ..... A24F 40/05 |
| EP | 3739269 A1 | * | 11/2020 | ..... F24F 1/0007 |

OTHER PUBLICATIONS

CN-213208094-U Translation (Year: 2021).*
CN-113907432-A Translation (Year: 2022).*
CN-111388720-A Translation (Year: 2020).*

* cited by examiner

*Primary Examiner* — Schyler S Sanks

(57) ABSTRACT

An air cooler includes a housing provided with an opening; a conveying mechanism provided in the opening, the conveying mechanism having a conveying channel, an air inlet and an air outlet that are in communication with the conveying channel; an atomizer provided in the housing and having a mist outlet in communication with the conveying channel, and the atomizer being configured to generate water mist and convey the water mist into the conveying channel through the mist outlet; and an air blowing assembly provided in the housing and facing the air inlet, the air blowing assembly being configured to blow air from the air inlet to the conveying channel and blow the water mist in the conveying channel out of the housing from the air outlet.

19 Claims, 6 Drawing Sheets

AIR COOLER

CROSS-REFERENCE TO RELATED APPLICATIONS

This application claims priority of Chinese Patent Application No. 202322718050.0, filed on Oct. 10, 2023, entitled "AIR COOLER", the entire content of which is incorporated herein by reference in its entirety.

TECHNICAL FIELD

The present disclosure relates to the technical field of household appliances, and in particular to an air cooler.

BACKGROUND

Air cooler is a mild cooling device that cools air mainly by absorbing heat during the evaporation of water. The conventional air cooler generally includes a water tank, a water pump, an air duct, a fan provided in the air duct, and a water curtain. During cooling, water in the water tank is pumped to an upper portion of the water curtain by the water pump, and a part of the water on the water curtain is evaporated. Under the action of the fan, airflow passing through the water curtain is blown to an air outlet of the air duct through an air inlet of the air duct, so that the blown air is cooler and more comfortable to achieve the effect of air cooling.

However, the structure of the conventional air cooler is relatively complex, and the cooling effect of using the water curtain is poor.

SUMMARY

According to various embodiments, an air cooler is provided.

An air cooler includes: a housing provided with an opening; a conveying mechanism provided in the opening, the conveying mechanism being provided with a conveying channel, an air inlet and an air outlet that are in communication with the conveying channel; an atomizer provided in the housing and having a mist outlet in communication with the conveying channel, and the atomizer being configured to generate water mist and convey the water mist into the conveying channel through the mist outlet; and an air blowing assembly provided in the housing and facing the air inlet, the air blowing assembly being configured to blow air from the air inlet to the conveying channel and blow the water mist in the conveying channel out of the housing from the air outlet.

In one of the embodiments, the conveying mechanism includes a front frame and a rear cover fixedly connected to the front frame, the front frame and the rear cover cooperatively enclose the conveying channel, the rear cover is opposite to the air blowing assembly, the air inlet is formed provided on the rear cover, and the air outlet is provided on a side of the front frame away from the rear cover.

In one of the embodiments, the front frame includes a bottom plate, the bottom plate is provided with a through hole in communication with the conveying channel and the mist outlet, and the through hole is located above the mist outlet.

In one of the embodiments, the conveying mechanism further includes a partition plate provided in the conveying channel, the partition plate divides the conveying channel into an air inlet channel and an air outlet channel, both the air inlet channel and the air outlet channel are in communication with the through hole, the air inlet is in communication with the air inlet channel, and the air outlet is in communication with the air outlet channel.

In one of the embodiments, the front frame is provided with a plurality of inserting strips and a plurality of positioning strips, the partition plate is provided with a plurality of inserting notches corresponding to the plurality of inserting strips, each inserting strip extends through a corresponding inserting notch and abuts against the rear cover, and an end of each positioning strip abuts against a side of the partition plate facing the air outlet.

In one of the embodiments, the rear cover includes an abutting member protruding toward the front frame, and the abutting member abuts against the partition plate.

In one of the embodiments, the rear cover further includes a connecting member protruding toward the front frame, the connecting member is provided with an engaging hole, an inner wall of the front frame is provided with a buckle corresponding to the engaging hole, and the buckle is detachably engaged in the engaging hole.

In one of the embodiments, the front frame is provided with a convex strip on a side thereof away from the rear cover, the convex strip includes two side walls opposite to each other and a connecting wall connected between the two side walls, the two side walls and the connecting wall cooperatively enclose a communicating cavity in communication with the conveying channel, and the air outlet is provided on the connecting wall and is in communication with the communicating cavity.

In one of the embodiments, both ends of the connecting wall in a length direction of the communicating cavity are bent toward each other.

In one of the embodiments, the housing includes an upper housing and a base, the opening is provided on the upper housing, the air blowing assembly and the conveying mechanism are located in the upper housing, and the atomizer is located in the base.

In one of the embodiments, the atomizer includes an atomizing member and an atomizing water tank connected to the atomizing member, the atomizing water tank is configured to store water, and the atomizing member is configured to atomize the water in the atomizing water tank to form the water mist and convey the water mist from the mist outlet to the conveying channel.

In one of the embodiments, the atomizing member is a ceramic atomizing sheet.

In one of the embodiments, the atomizing member is a microporous atomizing sheet.

In one of the embodiments, the atomizer further includes a detecting member provided in the atomizing water tank, and the detecting member is configured to detect whether the water is in the atomizing water tank and send out a water shortage warning when the air cooler operates and there is no water in the atomizing water tank.

In one of the embodiments, the air cooler further includes a water pump and a water storage tank that are provided in the base, the water storage tank is configured to pre-store the water, a water inlet end of the water pump is in communication with the water storage tank, a water outlet end of the water pump is in communication with a water outlet pipe, the water outlet pipe is in communication with the atomizing water tank, and the water pump is configured to convey the water in the water storage tank to the atomizing water tank.

In one of the embodiments, the air cooler further includes an anti-overflow tank provided in the base, the atomizing water tank is in communication with the anti-overflow tank through a drain pipe, and a position where the atomizing water tank is communication with the drain pipe is higher than a position where the anti-overflow tank is communication with the drain pipe.

In one of the embodiments, the position where the atomizing water tank is communication with the drain pipe is adjacent to a top end of the atomizing water tank.

In one of the embodiments, the air cooler further includes two groups of blades provided at the opening, one group of blades are spaced apart along an extending direction of the air outlet, another group of blades are spaced apart along a direction perpendicular to the extending direction of the air outlet, and the two groups of blades are rotatably connected to the housing.

In one of the embodiments, the air cooler further includes a grille provided between the air blowing assembly and the blades, the grille is fixedly connected to the housing, and the grille comprises a plurality of plates arranged around a center in a divergent manner.

In one of the embodiments, the air blowing assembly is a fan.

These and other features of the present disclosure will become readily apparent upon further review of the following specification and drawings.

BRIEF DESCRIPTION OF THE DRAWINGS

To illustrate the technical solutions in the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DESCRIPTION OF REFERENCE NUMERALS

1, housing; 11, upper housing; 111, opening; 112, blade; 113, grille; 12, base; 121. anti-overflow tank; 122, water pump; 123, water storage tank; 2, conveying mechanism; 21, front frame; 211, inserting strip; 212, positioning strip; 213, convex strip; 2131, side wall; 2132, connecting wall; 2133, communicating cavity; 2134, air outlet; 214, buckle; 215, through hole; 216, conveying cavity; 217, bottom plate; 218, side plate; 219, connecting plate; 22, rear cover; 221, air inlet; 223, connecting member; 2231, engaging hole; 224, abutting member; 23, conveying channel; 231, air inlet channel; 232, air outlet channel; 24, separating plate; 241, inserting notch; 3, atomizer; 31, atomizing member; 311, mist outlet; 312, sponge suction rod; 313, atomizing sheet body; 314, sleeve; 32, atomizing water tank; 33, water inlet pipe; 34, drain pipe; 35, detecting member; 4, air blowing assembly.

DETAILED DESCRIPTION OF THE EMBODIMENTS

In order to facilitate the understanding of the present disclosure, the present disclosure is described more comprehensively below with reference to the relevant accompanying drawings. Preferred embodiments of the present disclosure are shown in the accompanying drawings. However, the present disclosure may be implemented in many different forms and is not limited to the embodiments described herein. On the contrary, the purpose of providing these embodiments is to make the public content of the present disclosure more thoroughly and comprehensively understood.

It should be noted that when an element is called "fixed to" another element, it can be directly on another element or there can be an intermediate element. When an element is considered to be "connected" to another element, it can be directly connected to another element or there can be an intermediate element. The terms "vertical", "horizontal", "left", "right" and similar expressions used herein are for the purpose of illustration only and do not represent the only ways for implementation.

Unless otherwise defined, all technical and scientific terms used herein have the same meanings as those commonly understood by those skilled in the technical field of the present disclosure. The terms used in the specification of the present disclosure herein are only for the purpose of describing specific embodiments, and are not intended to limit the present disclosure. As used herein, the term "and/or" includes any and all combinations of one or more related listed items.

According to an embodiment, an air cooler is provided, which is capable of generating water mist and blowing out the water mist to lower a temperature of the environment, while also moisturizing the environment.

Figure 1:
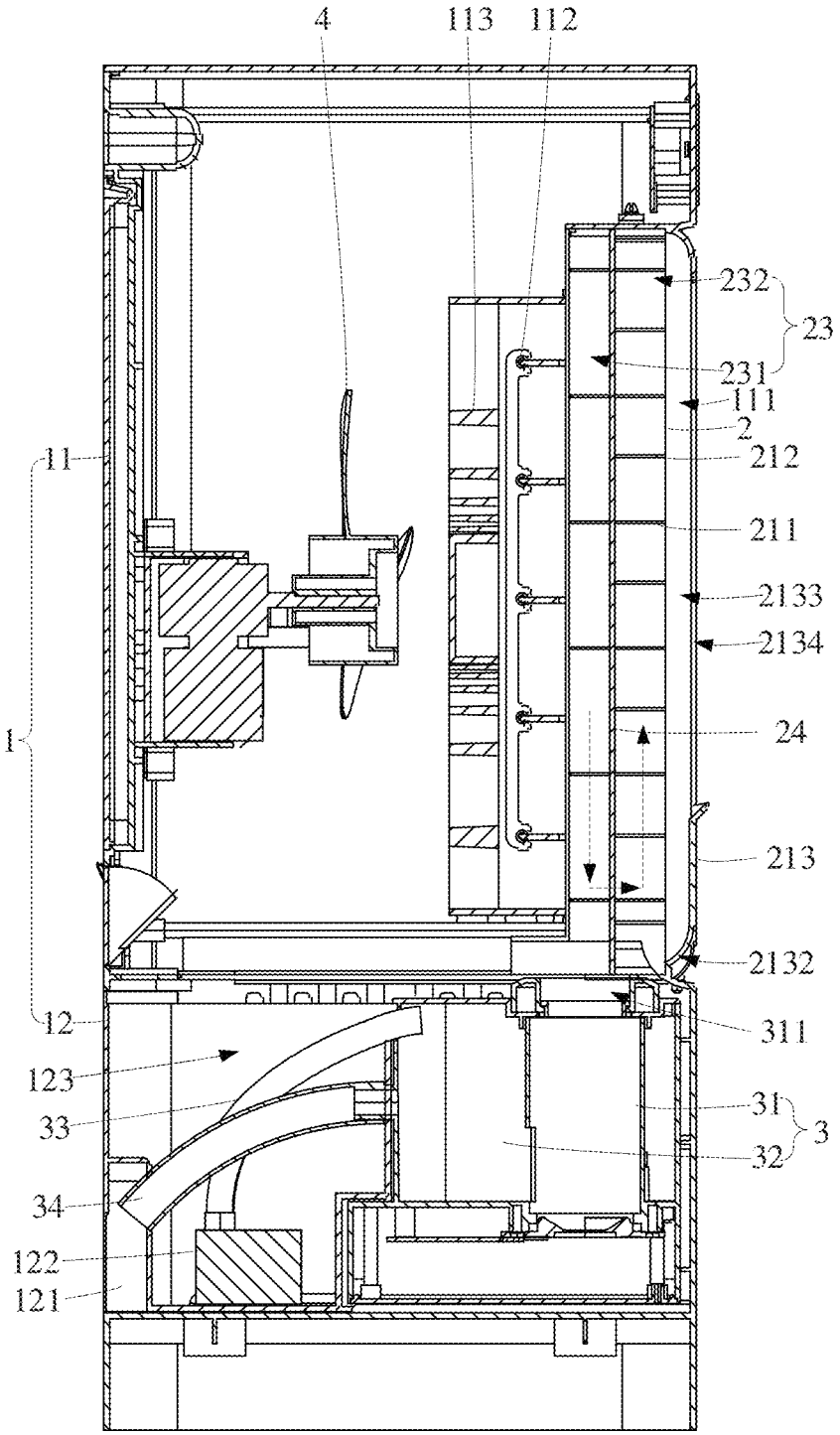
FIG. 1 is a cross-sectional view of an air cooler according to an embodiment.

Referring to FIG. 1, the air cooler includes a housing 1 and an air blowing assembly 4, an atomizer 3, and a conveying mechanism 2 that are provided in the housing 1. The housing 1 has an opening 111, and the conveying mechanism is arranged in the opening 111. The conveying mechanism 2 is provided with a conveying channel 23, an air inlet 221 and an air outlet 2134 that are in communication with the conveying channel 23. In an embodiment, the air inlet 221 and the air outlet 2134 are spaced apart on opposite sides of the conveying mechanism 2, and the conveying channel 23 is located between the air inlet 221 and the air outlet 2134. The atomizer 3 has a mist outlet 311 in communication with the conveying channel 23 and is configured to generate water mist and convey the water mist into the conveying channel 23 through the mist outlet 311. The air blowing assembly 4 is arranged facing the air inlet 221, and is configured to blow air from the air inlet 221 to the conveying channel 23 and blow the water mist in the conveying channel 23 out of the housing 1 from the air outlet 2134, so as to cool the external environment through the water mist. In an embodiment, the air blowing assembly 4 is a fan.

The air cooler can generate the water mist through the atomizer 3 and convey the water mist into the conveying channel 23 of the conveying mechanism 2. The air flow generated by the air blowing assembly 4 can enter the conveying channel 23 through the air inlet 221, and can flow along the conveying channel 23. During the flowing process of the air flow, the water mist entering the conveying channel 23 can be blown to the air outlet 2134, so that the water mist can be blown out from the air outlet 2134, the temperature of the environment can be reduced, the refrigeration effect can be achieved, and the humidity of the environment can be maintained. In addition, according to the air cooler, through the cooperation of the atomizer 3 and the conveying mechanism 2, only one conveying channel 23 is used for conveying the water mist, and the conveying channel 23 guides the airflow generated by the air blowing assembly 4 to flow, so as to convey the water mist out of the air cooler. Therefore, fewer parts are required, the structure is simple, and the production cost is reduced.

Referring to FIG. 1, in an embodiment, the housing 1 includes an upper housing 11 and a base 12. The upper housing 11 is fixedly connected to the base 12 by snap-fit connection, buckle connection or screw connection, etc. The opening 111 is provided on the upper housing 11. The air blowing assembly 4 and the conveying mechanism 2 are located in the upper housing 11, and the atomizer 3 is located in the base 12.

Figure 2:
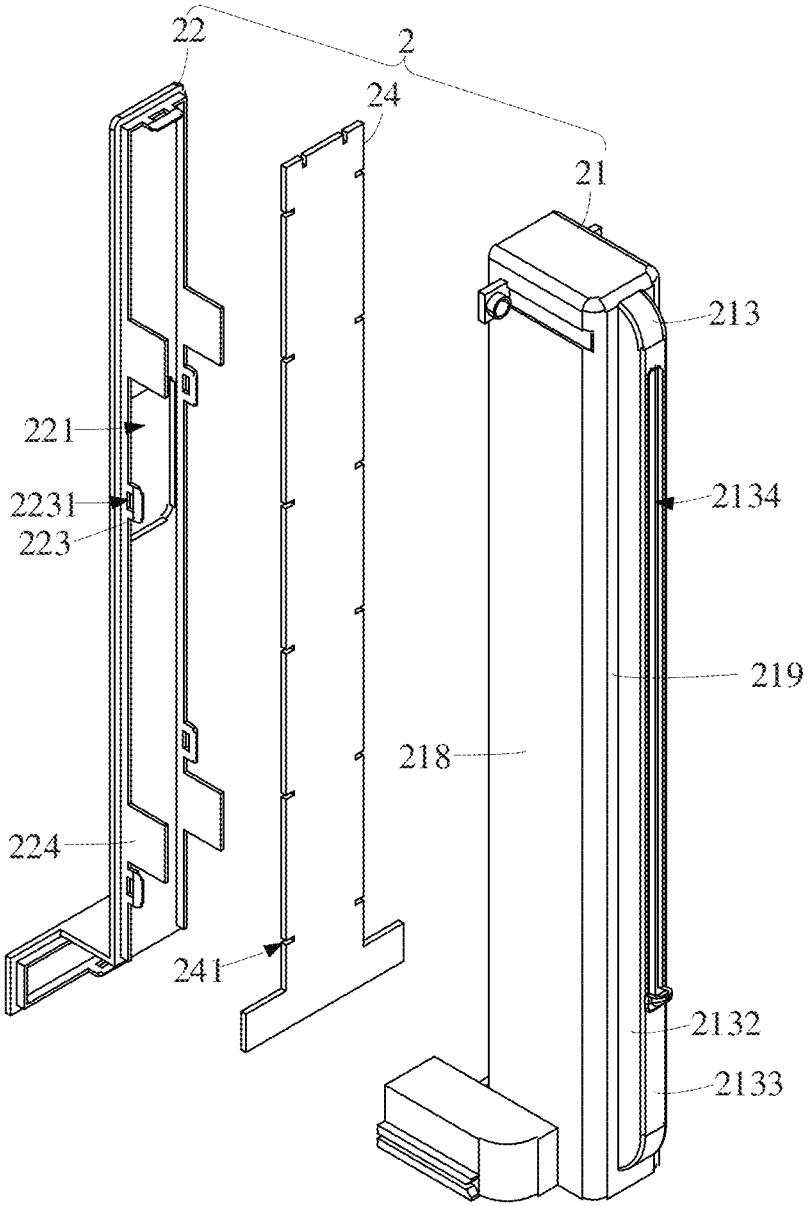
FIG. 2 is an exploded view of a conveying mechanism in FIG. 1.
Figure 3:
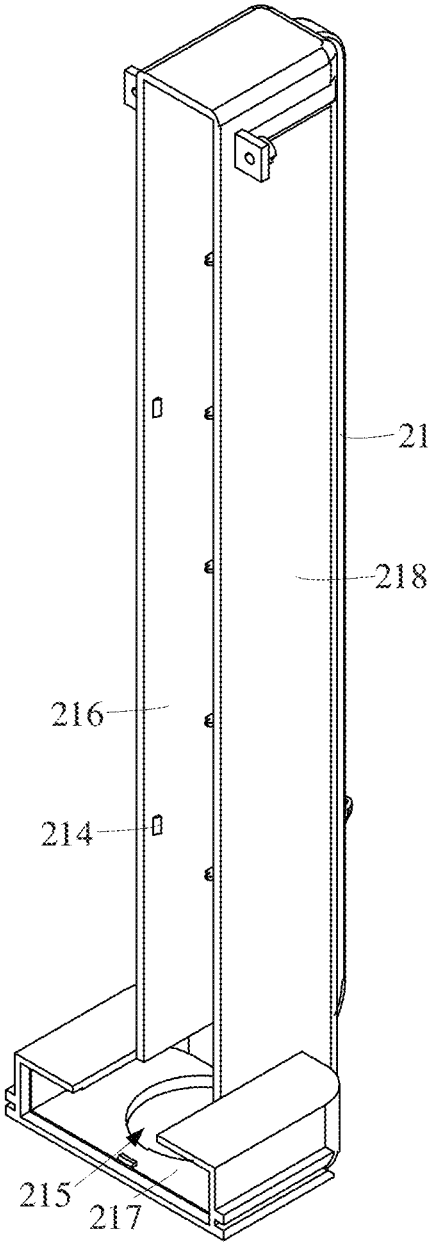
FIG. 3 is a perspective view of a front frame in FIG. 2.

Referring to FIG. 1 to FIG. 3, the conveying mechanism 2 includes a front frame 21 and a rear cover 22 fixedly connected to the front frame 21. The front frame 21 is provided with a conveying cavity 216. The rear cover 22 is fixed to a side of the front frame 21 where the conveying cavity 216 is located. A size of the rear cover 22 is adapted to a size of the conveying cavity 216, so that the rear cover 22 can cover the conveying cavity 216. The front frame 21 and the rear cover 22 cooperatively enclose the conveying channel 23. The rear cover 22 is opposite to the air blowing assembly 4. The air inlet 221 is provided on the rear cover 22, and the air outlet 2134 is provided on a side of the front frame 21 away from the rear cover 22. The air blown by the air blowing assembly 4 can enter the conveying channel 23 through the air inlet 221 and blow the water mist in the conveying channel 23 to the external environment through the air outlet 2134.

The front frame 21 includes a bottom plate 217, and the bottom plate 217 is provided with a through hole 215 in communication with the conveying channel 23 and the mist outlet 311, so that the water mist generated by the atomizer 3 is conveyed to the conveying channel 23 through the through hole 215. In an embodiment, the bottom plate 217 abuts against the atomizer 3, and the through hole 215 is located directly above the mist outlet 311. In this way, it is beneficial for the water mist to be conveyed into the conveying channel 23.

In order to prevent the water mist from leaking from a gap between the bottom plate 217 and the mist outlet 311, a connecting edge (not shown) is provided on the bottom plate 217 circumferentially around the through hole 215. An outer diameter of the connecting edge is slightly greater than an inner diameter of the mist outlet 311, and the connecting edge can be inserted into the mist outlet 311 in an interference fit manner, so that the connecting edge is tightly inserted in the mist outlet 311, and the anti-leakage effect is achieved.

Referring to FIG. 1 and FIG. 2, in an embodiment, the conveying mechanism 2 further includes a partition plate 24 provided in the conveying channel 23. The conveying channel 23 is divided into two different channels through the partition plate 24, one channel is used for air inlet, and the other channel is used for conveying a mixed air flow having the air flow and the water mist. A peripheral wall of the partition plate 24 abuts against an inner wall of the conveying channel 23 surrounded by the front frame 21, so as to divide the conveying channel 23 into an air inlet channel 231 located between the rear cover 22 and the partition plate 24 and an air outlet channel 232 located between the front frame 21 and the partition plate 24. Both the air inlet channel 231 and the air outlet channel 232 are in communication with the through hole 215. The air inlet channel 231 is in communication with the air inlet 221, and the air outlet 2134 is in communication with the air outlet channel 232. The air inlet channel 231 and the air outlet channel 232 have guiding functions, which not only can guide the air flow to the mist outlet 311 to carry the water mist for conveying, but also can guide the air flow carrying the water mist to flow to the air outlet 2134, so as to convey the water mist out of the air cooler from the air outlet 2134. The flow path of the airflow in the air inlet channel 231 and the air outlet channel 232 is shown by the arrows in FIG. 1.

The front frame 21 further includes two side plates 218 opposite to each other and a connecting plate 219 connected between the two side plates 218. The connecting plate 219 is provided with a plurality of inserting strips 211 and a plurality of positioning strips 212, and the plurality of inserting strips 211 and the plurality of positioning strips 212 are spaced apart, respectively. An edge of the partition plate 24 is provided with a plurality of inserting notches 241 corresponding to the plurality of inserting strips 211. Each inserting strip 211 extends into a corresponding inserting notch 241 and abuts against the rear cover 22, and an end of each positioning strip 212 abuts against a side of the partition plate 24 facing the air outlet 2134, so as to position the partition plate 24.

The rear cover 22 includes a plurality of abutting members 224 protruding toward the front frame 21. The plurality of abutting members 224 abut against the partition plate 24, such that the partition plate 24 is sandwiched between the plurality of abutting members 224 and the plurality of positioning strips 212. In this way, the partition plate 24 is sandwiched by the abutting member 224 and the positioning strip 212, and the inserting strips 211 are engaged in the inserting notches 241, so that the partition plate 24 can be stably fixed in the conveying channel 23 to prevent the partition plate 24 from being displaced.

The rear cover 22 further includes a plurality of connecting members 223 protruding toward the front frame 21, and each connecting member 223 is provided with an engaging hole 2231. An inner wall of the front frame 21 is provided with a plurality of buckles 214 corresponding to the engaging holes 223. The buckles 214 are detachably engaged in the engaging holes 223. In this way, the rear cover 22 is detachably connected to the front frame 21.

Each buckle 214 has an inclined surface or a curved surface. When the rear cover 22 is connected to the front frame 21, the connecting member 223 first abuts against the inclined surface or the curved surface of the buckle 214. At this time, the inclined surface or the curved surface serves as a guide to facilitate the buckling between the engaging holes 2231 and the buckles 214.

The connecting plate 19 is provided with a convex strip 213 on a side thereof away from the rear cover 22. A side of the convex strip 213 facing the rear cover 22 is provided with a communicating cavity 2133 in communication with the air outlet channel 232. The air outlet 2134 is provided on a side of the convex strip 213 away from the rear cover 22, and the air outlet 2134 extends along a length direction of the convex strip 213 and is in communication with the communicating cavity 2133.

Specifically, the convex strip 213 includes two side walls 2131 opposite to each other and a connecting wall 2132 connected between the two side walls 2131. The two side walls 2131 and the connecting wall 2132 cooperatively enclose a communicating cavity 2133 in communication with the conveying channel 23. The air outlet is 2134 is provided on the connecting wall 2132 and is in communication with the communicating cavity.

An extending direction of the communicating cavity 2133 enclosed by the two side walls 2131 and the connecting wall 2132 is parallel to an extending direction of the air outlet channel 232, and both ends of the connecting wall 2132 in the length direction of the communicating cavity 2133 are bent toward each other. By bending both ends of the connecting wall 2132, the airflow can be guided, so that the air flow can flow toward the air outlet 2134 better.

Figure 4:
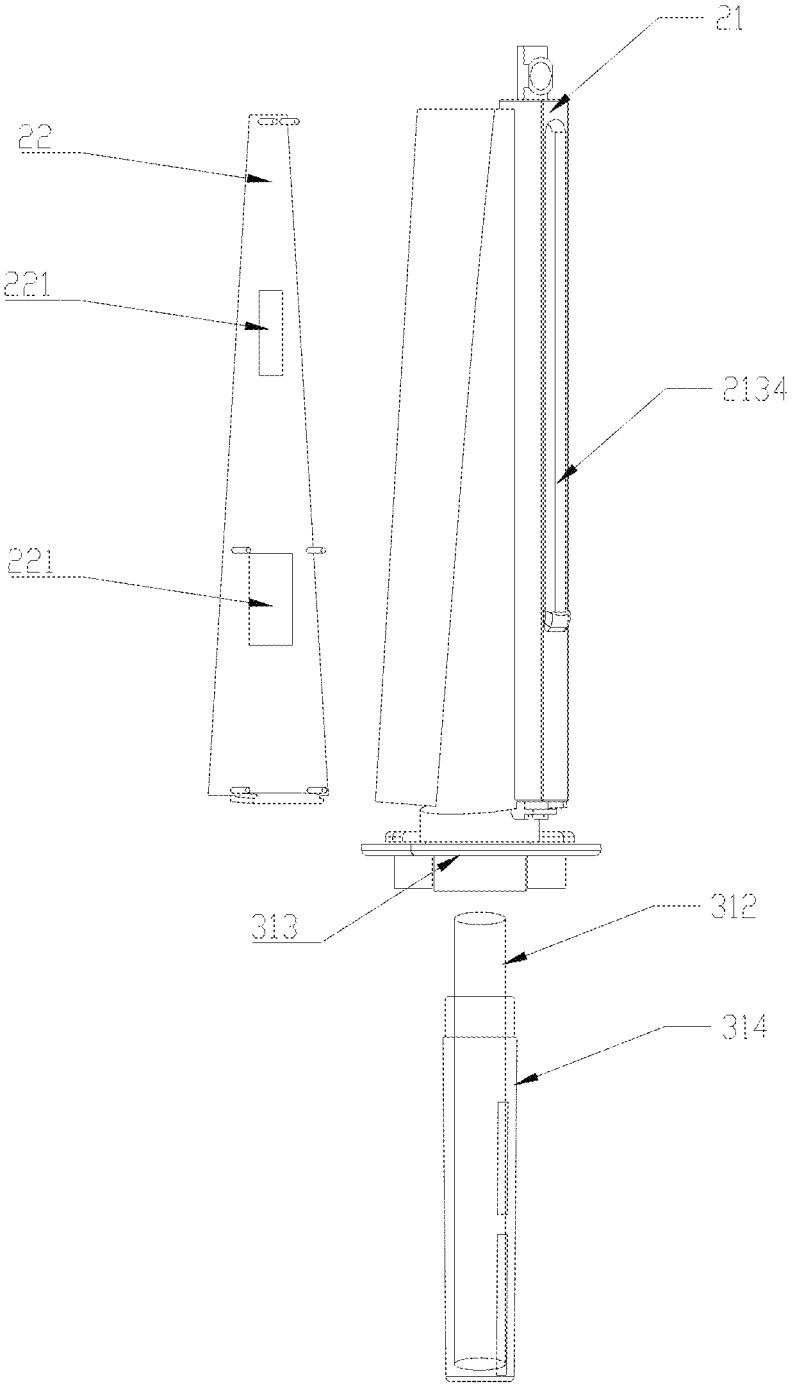
FIG. 4 is a schematic view of a conveying structure and an atomizing member in FIG. 1 according to an embodiment.

Referring to FIG. 1, the atomizer 3 includes an atomizing member 31 and an atomizing water tank 32 connected to the atomizing member 31. The atomizing water tank 32 is configured to store water required for atomization. The atomizing member 31 is configured to atomize the water in the atomizing water tank 32 to form the water mist and convey the water mist from the mist outlet 311 to the conveying channel 23. In an embodiment, the atomizing member 31 is a ceramic atomizing sheet, which utilizes the ultrasonic principle to transform the water into tiny water droplets, thereby generating water mist sprayed into the conveying channel 23. Referring to FIG. 4, in another embodiment, the atomizing member 31 is a microporous atomizing sheet. The atomizing member 31 includes a sponge suction rod 312, an atomizing sheet body 313 sleeved on the sponge suction rod 312, and a sleeve 314. An end of the sponge suction rod 312 is located in the atomizing water tank 32. The sleeve 314 may be made of plastic. Both ends of the sponge suction rod 312 extend through the sleeve 314. The sleeve 314 is fixed to the bottom of the front frame 21, thereby positioning the sponge suction rod 312 and the atomizing sheet body 313. The water sucked to the atomizing sheet body 313 through the sponge suction rod 312 is converted into water mist to be sprayed into the conveying channel 23 by the property of high-frequency ultrasonic oscillation of the atomizing member 31 itself. In this embodiment, a plurality of air inlets 221 are provided on the rear cover 22. It should be understood that in other embodiment, a plurality of air inlets 221 can also be provided.

The air cooler further includes a water pump 122 and a water storage tank 123 that are provided in the base 12. The water storage tank 123 is configured to pre-store the water required for atomization. A water inlet end of the water pump 122 is in communication with the water storage tank 123, a water outlet end of the water pump 122 is in communication with a water outlet pipe 33, and the water outlet pipe 33 is in communication with the atomizing water tank 32. The water pump 122 is configured to convey the water in the water storage tank 123 to the atomizing water tank 32. The storage tank 123 is also configured to place ice cubes to lower the temperature of the water.

The air cooler further includes an anti-overflow tank 121 provided in the base 12. The atomizing water tank 32 is in communication with the anti-overflow tank 121 through a drain pipe 34, and a position where the atomizing water tank 32 is communication with the drain pipe 34 is higher than a position where the anti-overflow tank 121 is communication with the drain pipe 34. In this way, when a water level of the atomizing water tank 32 reaches the position where the atomizing water tank 32 is connected to the drain pipe 34, the water in the atomizing water tank 32 can flow into the anti-overflow tank 121, so that the water level of the atomizing water tank 32 is always at a suitable position to prevent water from overflowing the atomizing water tank 32. In an embodiment, the position where the atomizing water tank 32 is communication with the drain pipe 34 is adjacent to a top end of the atomizing water tank 323, so that sufficient water can be supplied to the atomizing water tank 32 while ensuring that water does not overflow from the atomizing water tank 32.

Figure 5:
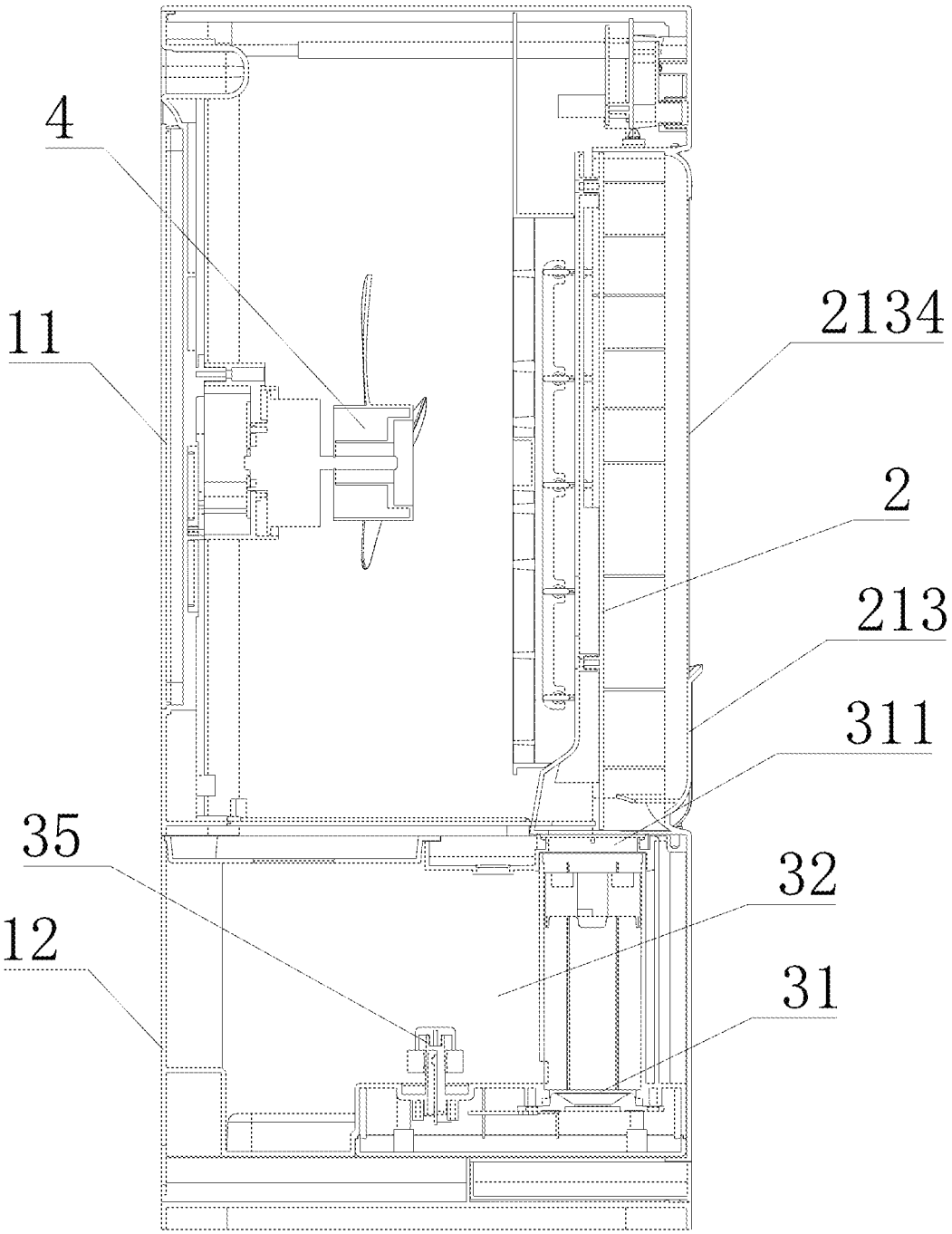
FIG. 5 is a cross-sectional view of an air cooler according to another embodiment.

Referring to FIG. 5, the air cooler according to another embodiment is provided, which is similar to the air cooler shown in FIG. 1. The main difference between the embodiments shown in FIG. 4 and FIG. 1 lies in that the air cooler in FIG. 4 does not include the water pump 122 and the water storage tank 123. The atomizing water tank 32 occupies most of the space of the base 12, so that the atomizing water tank 32 can contain enough water to supply water to the atomizing member 31 for atomization. The atomizer 3 further includes a detecting member 35 provided in the atomizing water tank 32. The detecting member 35 is configured to detect whether the water is in the atomizing water tank 32 and send out a water shortage warning when the air cooler operates and there is no water in the atomizing water tank 32, so as to remind a user to supply water to the atomizing water tank 32. It should be understood that, in the embodiment shown in FIG. 1, the detecting member 35 can also be provided in the atomizing water tank 32.

Figure 6:
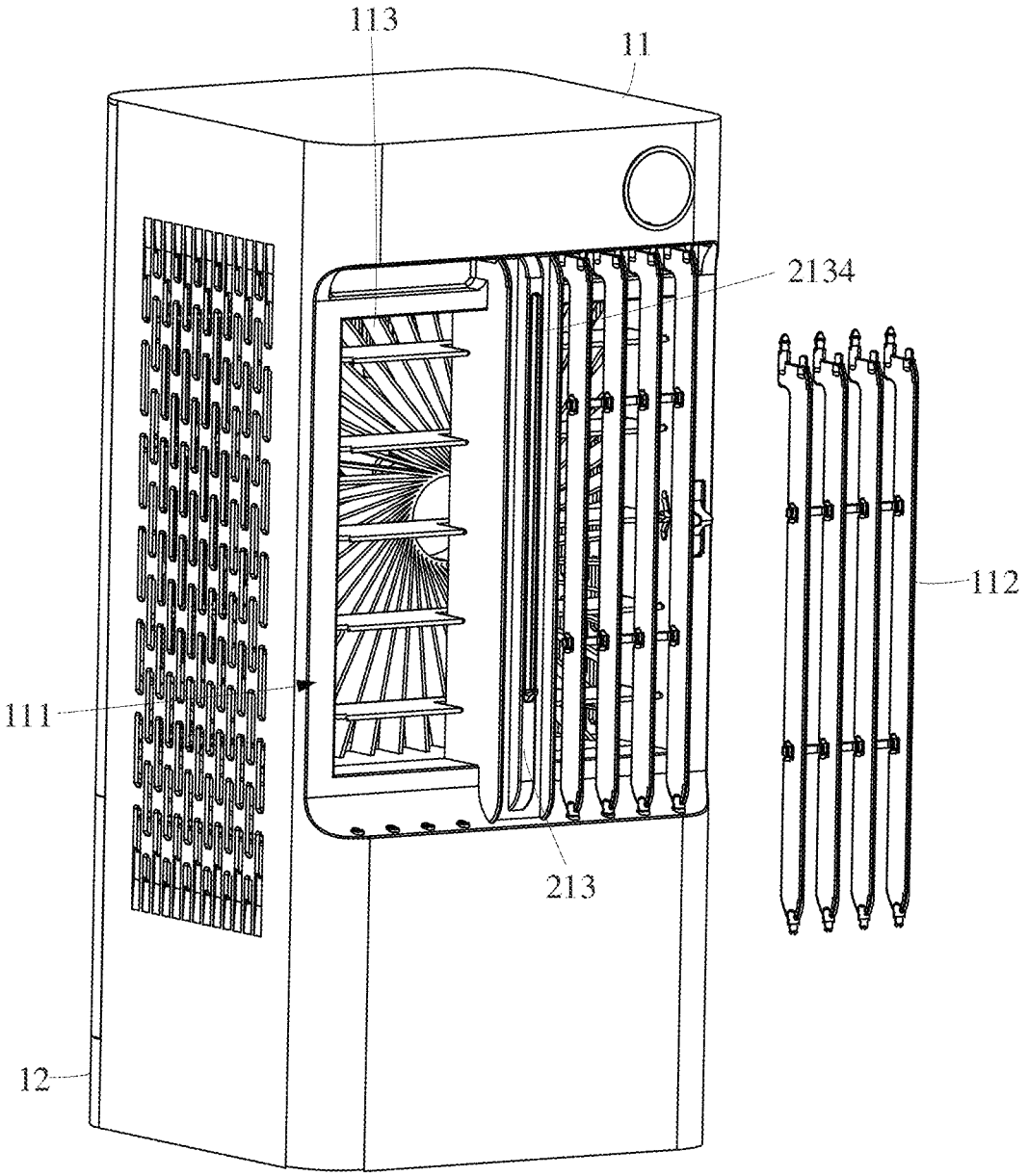
FIG. 6 is an exploded view of an air cooler according to an embodiment.

In an embodiment, referring to FIG. 1 and FIG. 6, the air cooler further includes a plurality of blades 112 provided at the opening 111. The plurality of blades 112 are divided into two groups, one group of blades 112 are spaced apart along the extending direction of the air outlet 2134, and the other group of blades 112 are spaced apart along a direction perpendicular to the extending direction of the air outlet 2134, and the group of blades 112 arranged horizontally is located between the group of blades 112 arranged vertically and the air blowing assembly 4. The two groups of blades 112 are rotatably connected to the upper housing 11, so that an air outlet direction can be adjusted by rotating the blades 112. In an embodiment, the blades 112 in the same group are arranged in parallel at equal intervals, so as to achieve an even airflow.

Furthermore, the air cooler further includes a grille 113 provided between the air blowing assembly 4 and the blades 112 arranged horizontally. The grille 113 is fixedly connected to the upper housing 11. The grille 113 includes a plurality of plates arranged around a center in a divergent manner. By providing the grille 113, not only the air blown by the air blowing unit 4 can be converged, but also the air blowing distance can be increased.

Although the respective embodiments have been described one by one, it shall be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other. Of course, the respective technical features mentioned in the same embodiment can also be combined arbitrarily as long as they have no collision with each other.

The foregoing descriptions are merely specific embodiments of the present disclosure, but are not intended to limit the protection scope of the present disclosure. Any variation or replacement readily figured out by a person skilled in the art within the technical scope disclosed in the present disclosure shall all fall within the protection scope of the present disclosure. Therefore, the protection scope of the present disclosure shall be subject to the protection scope of the appended claims.

What is claimed is:

1. An air cooler, comprising:

a housing provided with an opening;

a conveying mechanism provided in the opening, the conveying mechanism being provided with a conveying channel, an air inlet and an air outlet that are in communication with the conveying channel;

an atomizer provided in the housing and having a mist outlet in communication with the conveying channel, and the atomizer being configured to generate water mist and convey the water mist into the conveying channel through the mist outlet; and an air blowing assembly provided in the housing and facing the air inlet, the air blowing assembly being configured to blow air from the air inlet to the conveying channel and blow the water mist in the conveying channel out of the housing from the air outlet;

wherein the conveying mechanism comprises a front frame and a rear cover fixedly connected to the front frame, the front frame and the rear cover cooperatively enclose the conveying channel, the rear cover is opposite to the air blowing assembly, the air inlet is formed provided on the rear cover, and the air outlet is provided on a side of the front frame away from the rear cover.

2. The air cooler according to claim 1, wherein the front frame comprises a bottom plate, the bottom plate is provided with a through hole in communication with the conveying channel and the mist outlet, and the through hole is located above the mist outlet.

3. The air cooler according to claim 2, wherein the conveying mechanism further comprises a partition plate provided in the conveying channel, the partition plate divides the conveying channel into an air inlet channel and an air outlet channel, both the air inlet channel and the air outlet channel are in communication with the through hole, the air inlet is in communication with the air inlet channel, and the air outlet is in communication with the air outlet channel.

4. The air cooler according to claim 3, wherein the front frame is provided with a plurality of inserting strips and a plurality of positioning strips, the partition plate is provided with a plurality of inserting notches corresponding to the plurality of inserting strips, each inserting strip extends through a corresponding inserting notch and abuts against the rear cover, and an end of each positioning strip abuts against a side of the partition plate facing the air outlet.

5. The air cooler according to claim 4, wherein the rear cover comprises an abutting member protruding toward the front frame, and the abutting member abuts against the partition plate.

6. The air cooler according to claim 4, wherein the rear cover further comprises a connecting member protruding toward the front frame, the connecting member is provided with an engaging hole, an inner wall of the front frame is provided with a buckle corresponding to the engaging hole, and the buckle is detachably engaged in the engaging hole.

7. The air cooler according to claim 1, wherein the front frame is provided with a convex strip on a side thereof away from the rear cover, the convex strip comprises two side walls opposite to each other and a connecting wall connected between the two side walls, the two side walls and the connecting wall cooperatively enclose a communicating cavity in communication with the conveying channel, and the air outlet is provided on the connecting wall and is in communication with the communicating cavity.

8. The air cooler according to claim 7, wherein both ends of the connecting wall in a length direction of the communicating cavity are bent toward each other.

9. The air cooler according to claim 1, wherein the housing comprises an upper housing and a base, the opening is provided on the upper housing, the air blowing assembly and the conveying mechanism are located in the upper housing, and the atomizer is located in the base.

10. The air cooler according to claim 9, wherein the atomizer comprises an atomizing member and an atomizing water tank connected to the atomizing member, the atomizing water tank is configured to store water, and the atomizing member is configured to atomize the water in the atomizing water tank to form the water mist and convey the water mist from the mist outlet to the conveying channel.

11. The air cooler according to claim 10, wherein the atomizing member is a ceramic atomizing sheet.

12. The air cooler according to claim 10, wherein the atomizing member is a microporous atomizing sheet, the microporous atomizing sheet comprises a sponge suction rod, an atomizing sheet body sleeved on the sponge suction rod, and a sleeve, an end of the sponge suction rod is located in the atomizing water tank, both ends of the sponge suction rod extend through the sleeve, and the sleeve is fixed to the housing.

13. The air cooler according to claim 10, wherein the atomizer further comprises a detecting member provided in the atomizing water tank, and the detecting member is configured to detect whether the water is in the atomizing water tank and send out a water shortage warning when the air cooler operates and there is no water in the atomizing water tank.

14. The air cooler according to claim 10, further comprising a water pump and a water storage tank that are provided in the base, wherein the water storage tank is configured to pre-store the water, a water inlet end of the water pump is in communication with the water storage tank, a water outlet end of the water pump is in communication with a water outlet pipe, the water outlet pipe is in communication with the atomizing water tank, and the water pump is configured to convey the water in the water storage tank to the atomizing water tank.

15. The air cooler according to claim 14, further comprising an anti-overflow tank provided in the base, wherein the atomizing water tank is in communication with the anti-overflow tank through a drain pipe, and a position where the atomizing water tank is communication with the drain pipe is higher than a position where the anti-overflow tank is communication with the drain pipe.

16. The air cooler according to claim 15, wherein the position where the atomizing water tank is communication with the drain pipe is adjacent to a top end of the atomizing water tank.

17. The air cooler according to claim 1, further comprising two groups of blades provided at the opening, wherein one group of blades are spaced apart along an extending direction of the air outlet, another group of blades are spaced apart along a direction perpendicular to the extending direction of the air outlet, and the two groups of blades are rotatably connected to the housing.

18. The air cooler according to claim 17, further comprising a grille provided between the air blowing assembly and the blades, wherein the grille is fixedly connected to the housing, and the grille comprises a plurality of plates arranged around a center in a divergent manner.

19. The air cooler according to claim 1, wherein the air blowing assembly is a fan.

* * * * *